US006230801B1

(12) United States Patent
Hill, Jr. et al.

(10) Patent No.: US 6,230,801 B1
(45) Date of Patent: May 15, 2001

(54) APPARATUS AND METHOD FOR OPEN HOLD GRAVEL PACKING

(75) Inventors: Leo E. Hill, Jr., Huffman; Christian F. Bayne, The Woodlands, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/359,245

(22) Filed: Jul. 22, 1999

Related U.S. Application Data

(60) Provisional application No. 60/093,714, filed on Jul. 22, 1998.

(51) Int. Cl.[7] ..... E21B 33/122; E21B 43/04; E21B 43/110

(52) U.S. Cl. ..... 166/278; 166/51; 166/194; 166/386; 166/387

(58) Field of Search ..... 166/51, 191, 194, 166/276, 278, 374, 377, 386, 387

(56) References Cited

U.S. PATENT DOCUMENTS

| | | | | |
|---|---|---|---|---|
| 3,952,804 | | 4/1976 | Smyrl | 166/278 |
| 4,522,264 | * | 6/1985 | McNeer | 166/278 |
| 4,700,777 | * | 10/1987 | Luers | 166/51 X |
| 4,915,172 | * | 4/1990 | Donovan et al. | 166/278 |
| 5,069,280 | * | 12/1991 | McKee et al. | 166/278 |
| 5,333,688 | | 8/1994 | Jones et al. | 166/278 |
| 5,373,899 | | 12/1994 | Dore et al. | 166/278 |
| 5,505,260 | * | 4/1996 | Anderson et al. | 166/278 |
| 5,676,208 | | 10/1997 | Finley | 166/278 |
| 5,875,852 | * | 3/1999 | Floyd et al. | 166/191 X |
| 5,931,229 | * | 8/1999 | Lehr et al. | 166/278 |
| 5,971,070 | * | 10/1999 | Ross et al. | 166/278 |
| 6,095,245 | * | 8/2000 | Mount | 166/276 |

OTHER PUBLICATIONS

Duhon et al., Halliburton Energy Services, "New Completion Techniques Applied to a Deepwater Gulf of Mexico TLP Completion Successfully Gravel Pack an Openhole Horizontal Interval of 2400 Feet," XP–00212001, OTC Proceedings, 1998 Offshore Technology Conference (13 pages).

* cited by examiner

*Primary Examiner*—George Suchfield
(74) *Attorney, Agent, or Firm*—Madan, Mossman & Sriram, P.C.

(57) ABSTRACT

The present invention provides apparatus and method for gravel packing open holes wherein hydrostatic pressure is maintained above the formation pressure ("overburdened condition") throughout the gravel pack process. The apparatus includes a completion string which contains a flow restriction device, a crossover device and a packer each above and below the crossover device. The string is set in the wellbore with the flow restriction device adjacent the producing formation. The upper packer and the crossover device are set, which allows the gravel fluid to pass to the annulus, and return through the string. After gravel packing, the lower packer is set. The crossover device and the upper packer are retrieved from the wellbore leaving the flow restriction device and the lower packer in the wellbore. The system maintains the wellbore under overburdened condition throughout the gravel packing process.

16 Claims, 8 Drawing Sheets

APPARATUS AND METHOD FOR OPEN HOLD GRAVEL PACKING

CROSS-REFERENCE TO RELATED APPLICATION

This application takes priority from U.S. patent application Ser. No. 60/093,714 filed Jul. 22, 1998.

BACKGROUND OF THE INVENTION

1. Field of the Invention

This invention relates generally to oil well completion strings and more particularly to a hydrostatically-balanced open hole gravel pack system wherein hydrostatic pressure is maintained on the formation throughout the gravel packing operations.

2. Description of the Art

To obtain hydrocarbons from earth's subsurface formations, wellbores or boreholes are drilled into hydrocarbon-bearing formations or producing zones. After drilling a wellbore to the desired depth, a completion string containing various completion and production devices is installed in the wellbore to produce the hydrocarbons from the production zone to the surface. In one method, a fluid flow restriction device, usually containing one or more serially connected screens, is placed adjacent the production zone. Gravel is then packed in the space or annulus between the wellbore and the screen. No casing is installed between the screens and the wellbore. Such completions are called "open hole" completions and the systems used to gravel pack are called open hole gravel pack systems.

In commercially used open hole gravel packing system a completion string is frequently utilized for gravel packing. The completion string usually includes a screen near its bottom (or the downhole end), at least one packer or packing element above the screens, and a mechanism above the packer that allows gravel slurry to flow it from the surface to the annulus between the screens and the wellbore, and the clean fluid to return from the completion string to the surface. To gravel pack the annulus between the formation and the completion string, packer is set to form a seal between the completion string and the wellbore, the packer prevents the hydrostatic pressure from being applied to the formation, which prevents, for a period of time, maintaining the hydrostatic pressure above the formation pressure (the "overbalanced condition" or "overburdened condition") during the gravel pack operation. Thus, the formation pressure can exceed the hydrostatic pressure, which can cause hole damage or well collapse and damage to the filter cake.

A substantial number of currently drilled wellbores are highly deviated or horizontal. The horizontal wellbores are extremely susceptible to damage if the overbalanced conditions are not maintained throughout the gravel pack operations or during any other completion operation. Maintaining the wellbore under overbalanced condition throughout the gravel packing, especially in highly deviated and horizontal wells is very desirable. The present invention provides a gravel pack system and method which maintains the pressure on the formation above the formation pressure throughout the gravel packing operation. The present system also is simpler and easier to use, thereby reducing the overall completion or gravel pack operations time and cost.

SUMMARY OF THE INVENTION

The present invention provides apparatus and method for gravel packing open holes wherein hydrostatic pressure on the formation is maintained above the formation pressure throughout the gravel pack process. In one embodiment, the gravel pack apparatus includes a completion string which contains a fluid flow restriction device, a crossover device uphole of the fluid flow restriction device and a packer above and below the crossover device. The completion string is conveyed in the wellbore to position the flow restriction device adjacent the producing formation while maintaining the wellbore under overburdened conditions. The upper packer and the crossover device are set while maintaining the wellbore under overburdened condition. This allows the gravel fluid to pass to the annulus and return through the completion string. The returning fluid crosses over to the annulus above the upper packer. After gravel packing, the lower packer is set. The portion of the completion string above the lower packer, which includes the crossover device and the upper packer are retrieved from the wellbore, thus leaving the fluid flow restriction device and the lower packer in the wellbore. In this particular embodiment, setting the lower packer after the gravel packing process has been completed enables maintaining the hydrostatic pressure on the formation throughout the gravel packing process.

Examples of the more important feature of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals.

DETAILED DESCRIPTION OF THE PREFERRED EMBODIMENT

Figure 1A:
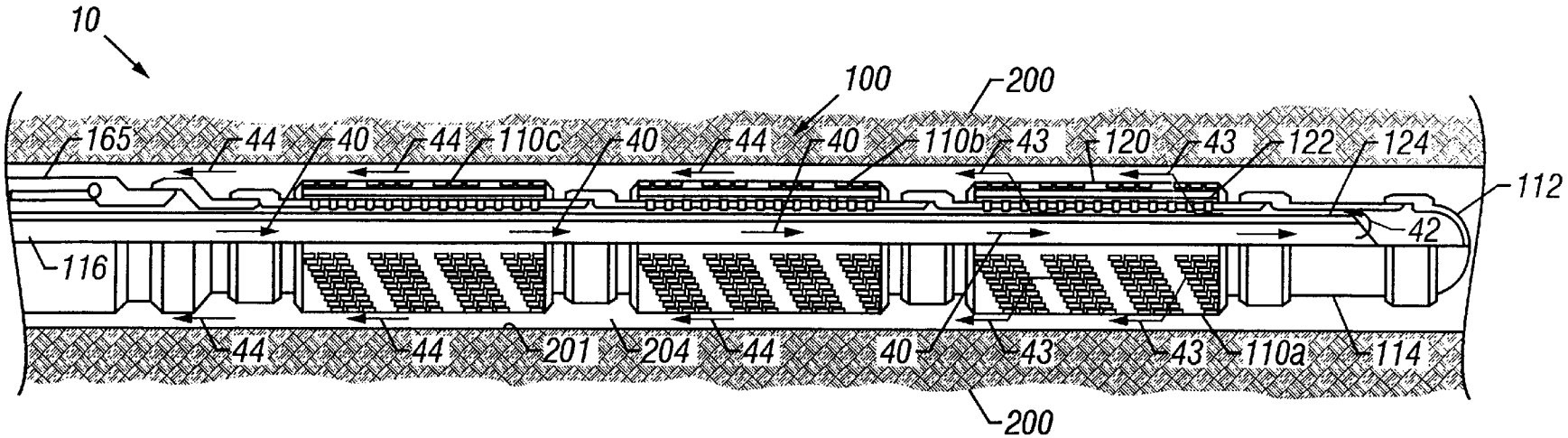
FIGS. 1A–1D show a schematic diagram of a gravel pack string for placement in the wellbore and the wellbore fluid flow path to hydrostatically balance the formation.
Figure 2A:
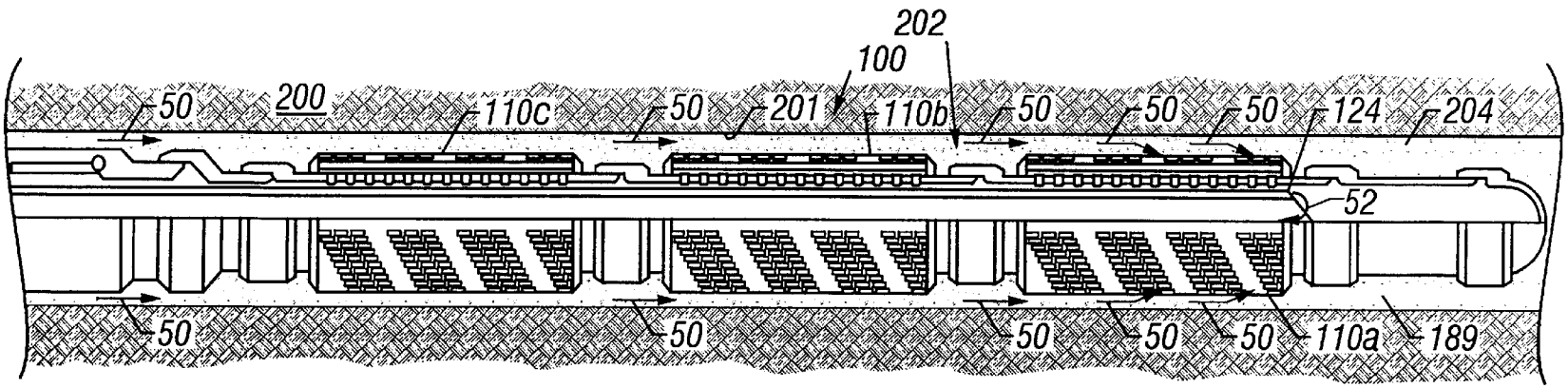
FIGS. 2A–2D show a schematic diagram of the gravel pack string with the upper or service packer set and the fluid flow path which enables maintaining the hydrostatic pressure on the formation.
Figure 1B:
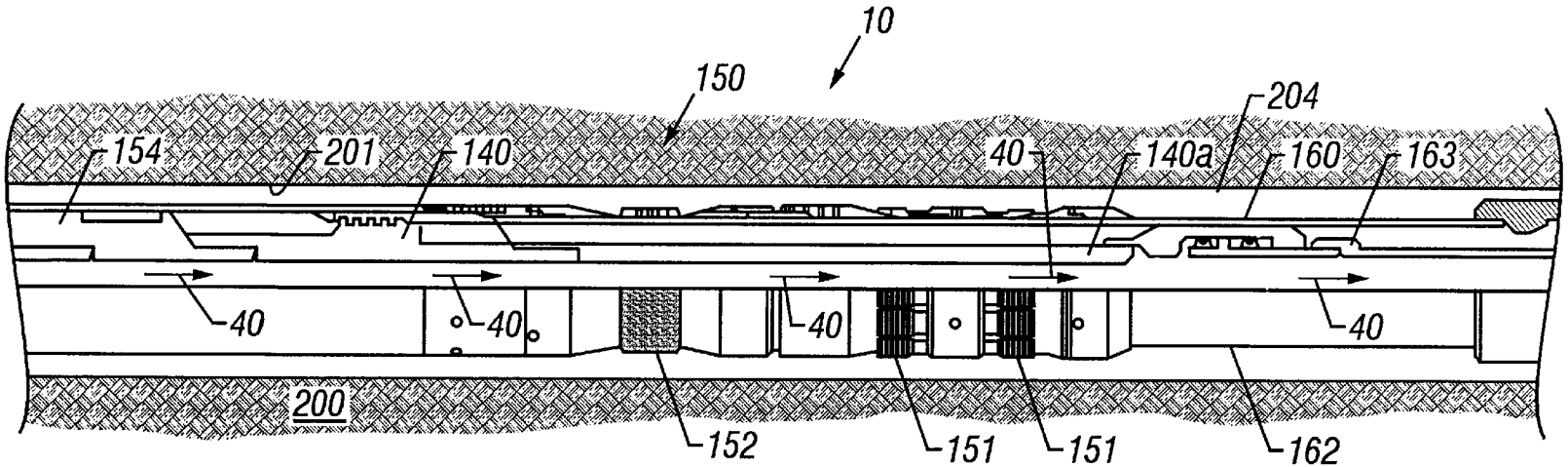
Figure 2B:
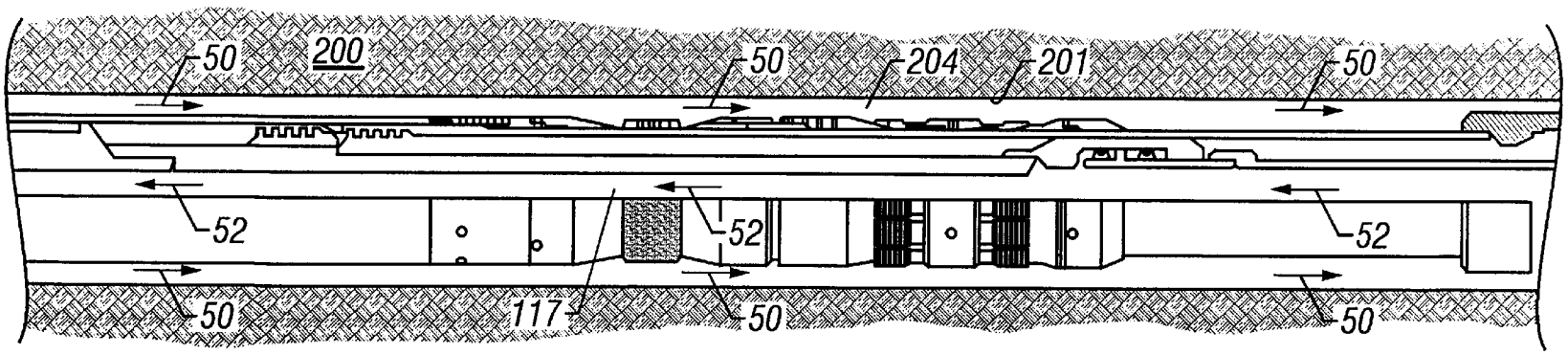

FIGS. 1A–1D, 2A–2D, 3A–3D, and 4A–4D show a gravel pack system 10 according to one embodiment of the present invention in various stages of gravel pack operations.

Referring to FIGS. 1A–1D, the system 10 includes a fluid flow restriction device 100 having a number of serially disposed screen assemblies 110*a*–110*c*. The fluid flow restriction device 100 terminates at the bottom end of the string 10 with a plug 112 and a casing joint 114. Each screen assembly, such as assembly 110*a*, includes an outer shroud 120 and an inner sand screen 122. The shroud 120 protects the internal parts of the screen assembly 110*a* from direct impact of the production fluid 202, while the screen 122 prevents gravel, sand and other small solid particles from penetrating into the flow restriction device inside 116. The screen 122, however, maintains the string inside 116 in fluid communication with the formation 200. Any fluid 40 supplied from the surface into the opening 116 at a pressure greater than the pressure of the formation 200 travels downhole to the plug 112. This fluid then returns uphole (return fluid 42) via an opening 124 at the casing joint 114. The returning fluid 42 passes through the screen assemblies 110*a*–110*c* (as shown by arrows 43) to the annulus 204 between the flow restriction device 100 and the wellbore 201 and travels uphole via the annulus 204, as shown by arrows 44. The purpose of the flow restriction device 100 is to prevent solids present in the production fluid 202 to pass into the opening 116 of the string 10. It also prevents passage of any gravel though the screens 122 into the completion string inside 116 that is supplied to the annulus 204 from the surface.

A liner packer 150 is disposed uphill of (above) the flow restriction device 100. A casing nipple 160 and a knock-out isolation valve 165 are serially coupled between the liner packer 150 and the flow restriction device 100. A running tool 140 in the liner packer 150 is used to convey the liner packer 150 and the flow restriction device 100 into the wellbore 201. An end 140*a* of the running tool couples a swivel sub 162 in the casing nipple 160. The swivel sub 162 allows the tool portion above or uphole of the swivel sub 162 to rotate while maintaining stationary the tool portion 163 below the swivel sub.

The liner packer 150 includes setting slips 151 and one or more packing elements 152. A liner packer setting dog (not shown) when moved downhole, causes the packer elements 152 to set, i.e., extend outward to the wellbore inside walls. Seals 144 in a junk bonnet 145 at the top of the liner packer 150 allow a polished stinger 143 to maintain seal. In the above-described configuration, the running tool 140 is attached to the section of the completion string that includes the liner packer assembly 150 and the flow restriction device 100 (referred to herein as the "bottom hole assembly" or the "BHA"). This allows an operator to rotate and release the running tool 140 from the bottom hole assembly to pull out the upper section of the completion string 100 out of the wellbore 201, leaving behind the BHA in the wellbore 201.

Figure 1C:
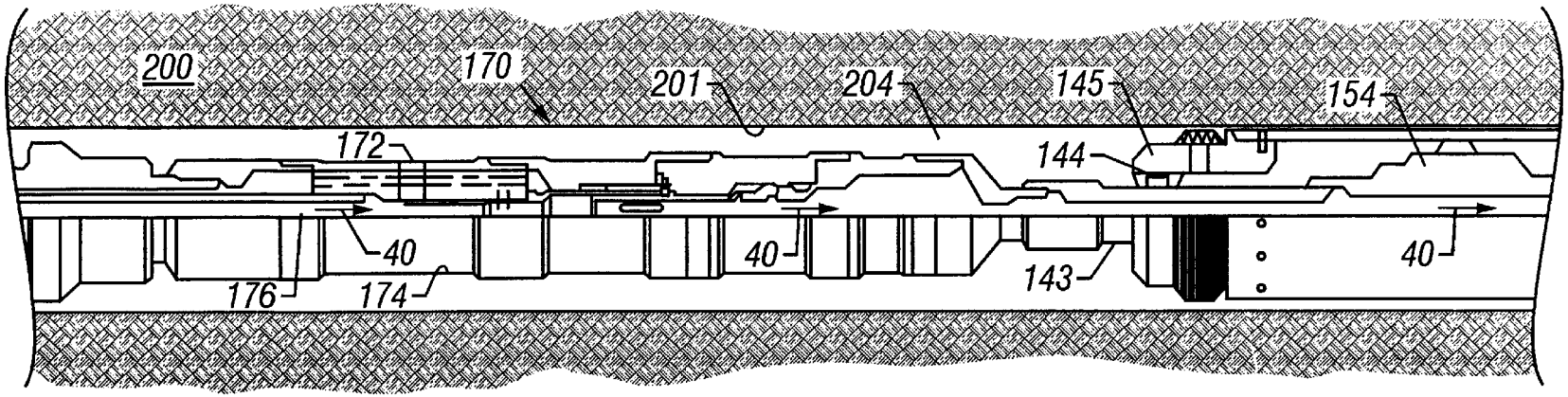
Figure 2C:
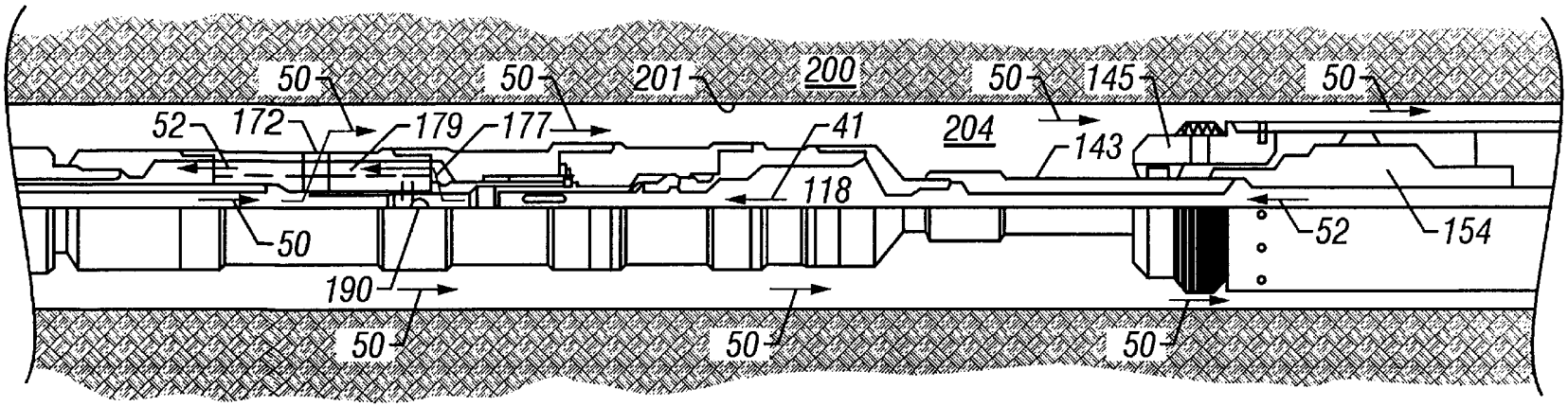
Figure 1D:
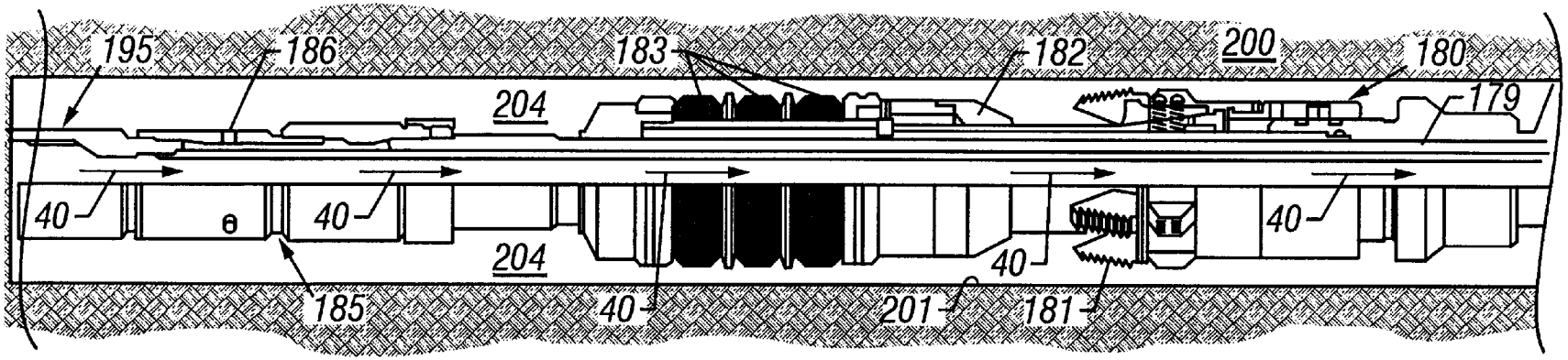
Figure 2D:
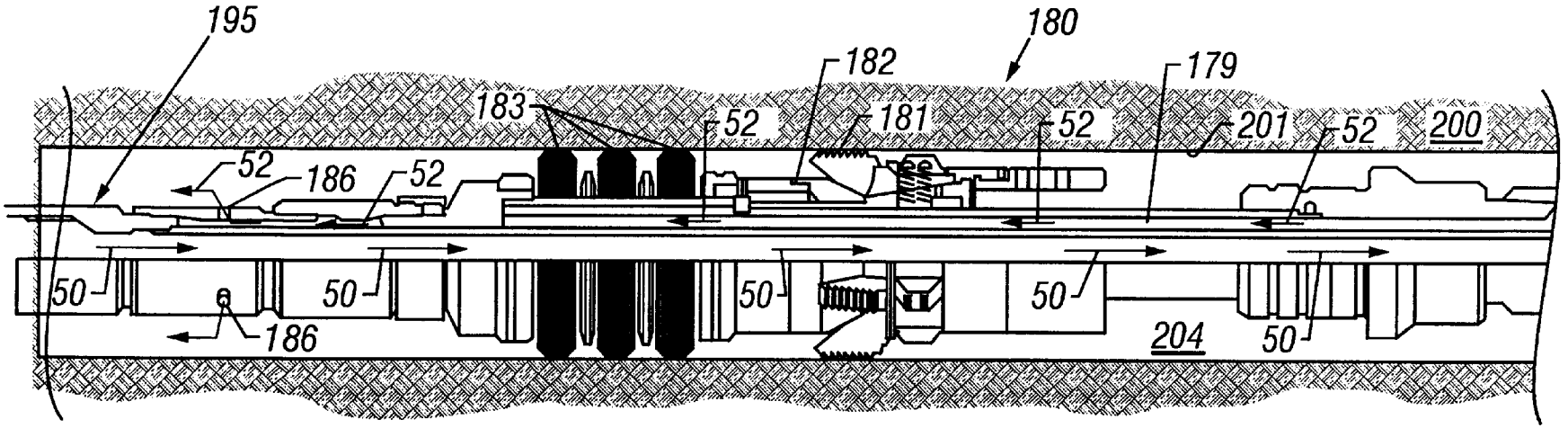
Figure 3A:
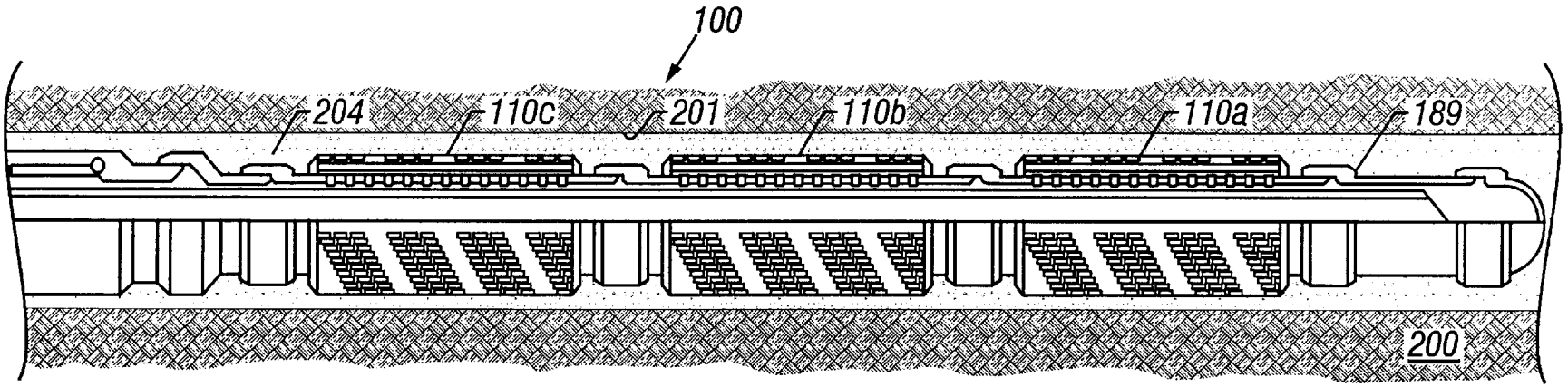
FIGS. 3A–3D show the gravel pack system of FIGS. 1A–1D with the service packer set for a reverse circulation flow path.
Figure 3B:
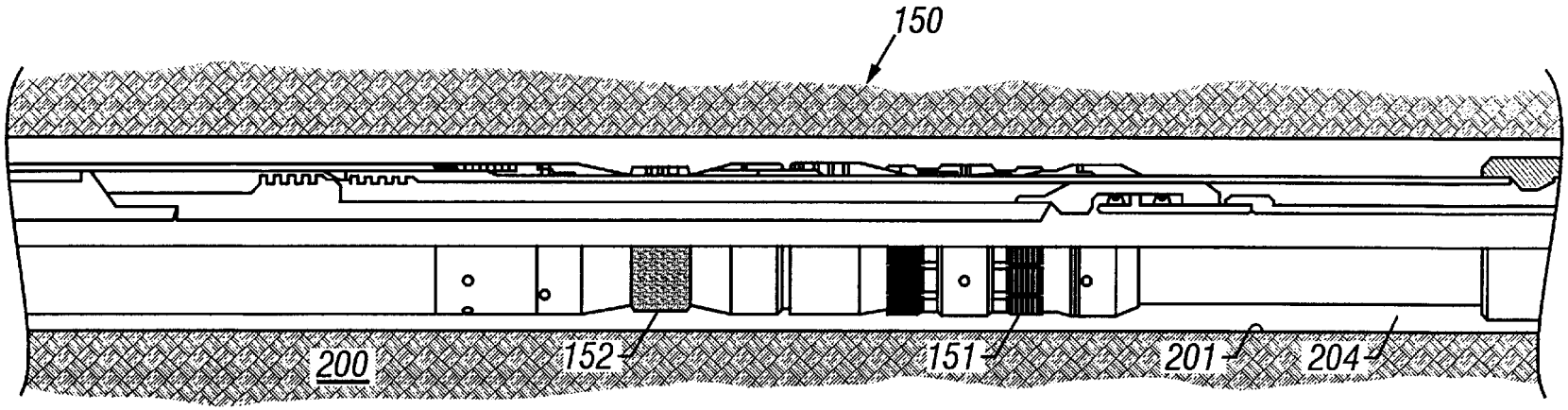

A crossover port assembly or device 170 is coupled uphole of the liner packer assembly 150 through the stringer 143. The crossover port assembly 170 includes a port 172 which is initially closed off by a sleeve 174. When the port 172 is closed, as shown in FIG. 1C, fluid supplied under pressure from the surface flows down to an opening 176 in the crossover port assembly 170 and continues to flow through the liner packer assembly 150 and the flow restriction device 100 as show by arrows 40. When the sleeve 174 is moved downward, i.e., downhole, the port 172 opens. If the flow path below the port 172 is blocked, then any fluid supplied to the completion string 10 above the port 172 will flow through the port 172 and into the annulus 204 and eventually return uphole through the central bore 116 along the completion string 10 length. In the particular embodiment of FIGS. 1A–1D, a gravel pack kit 185 and a service packer 180 are disposed uphole of the crossover device 170.

The service packer 180 can be hydraulically set to block or restrict fluid flow through the annulus 204 uphole of the crossover device 170. The gravel pack kit 185 includes a port 186 that allows the fluid to flow from a reverse fluid flow path 179 in the service packer 180 to the annulus 204 above the service packer 180 as more fully explained below. The service packer 180 includes slips 181 and a plurality of packing elements 183. Thus, the gravel pack system or completion string 10 shown in FIGS. 1A–1D includes in a substantially serial relation a flow restriction device 100, a liner packer 150 above the flow restriction device 100, a crossover port assembly tool 170, and a service packer 180 uphole of the crossover device 170. The gravel packing around the flow restriction device 100 while maintaining the hydrostatic pressure above the formation pressure will now be described while referring to FIGS. 1–4.

The completion string 10 shown in FIGS. 1A–1D is conveyed into the wellbore 201 to a desired depth to position the flow restriction device 100 adjacent the producing formation 200. A wellbore fluid 40 is pumped from a source thereof at the surface (not shown) into the completion string 10. The fluid flows through the string 10 as shown by the arrows 40 and returns to the surface via the annulus 204 as shown by the arrows 43. The fluid in the wellbore maintains the hydrostatic pressure over the formation 200, i.e., maintains the wellbore under overburdened condition.

Once the string 10 is correctly positioned in the wellbore 201, the running tool 140 is released (or disengaged) from the liner packer 150 by rotating the pipe or the work string (attached above the string 10), which rotates the string 10 above the swivel sub 162. The work string is then moved up or uphole, which causes the slips 181 of the service packer 180 to move over members 182, which sets the packer elements 183 of the service packer 180 (See FIGS. 2A–2D). Setting of the service packer 180 blocks any fluid flow through the annulus 204 around the packer elements 183. Since the fluid in the string 10 remains in fluid communication with the formation 200, it maintains the hydrostatic pressure on the formation 200.

After setting the service packer 180, a ball 190 is dropped into the completion string 10, which moves the sleeve 174, thus opening the port 172. The ball 190 seats in position in the crossover assembly 170 and prevents fluid flow through the crossover assembly 170 past the ball 190. The movement of sleeve 174 also opens a reverse fluid flow path 177 in the crossover port assembly which is further in fluid communication with fluid path 179 in the service packer assembly 180. Thus, activating or setting the crossover assembly 170 causes any fluid supplied from the surface to flow through the string 10 to the port 172 and then over to the annulus 204 via the port 172. The fluid then flows downhole through the annulus 204 and passes through the screens 110*a*–110*c* and then into the string opening 116 as shown by arrows 50 (FIGS. 2A–2D). The fluid then flows uphole through the opening 116 in the flow restriction assembly 100 and then through openings 117 and 118 respectively in the liner packer 150 and the crossover tool 170. The fluid then crosses over to the line or opening 179 through the service packer via crossover opening 177. The fluid from line 179 passes into the annulus 204 above the packer 180 via port 186 in the crossover kit 195. The downhole fluid flow path after the setting of the crossover assembly 170 is depicted by arrows 50, while the uphole fluid flow path of the returning fluid is shown by arrows 52. Thus, during the setting of the crossover assembly 170 to establish fluid flow below the service packer via the annulus 204, the fluid in the wellbore 201 remains in fluid communication with the formation 200, thereby maintaining the hydrostatic pressure on the formation 200.

Still referring to FIGS. 2A–2D, once the service packer 180 has been set, fluid 188 with gravel or sand 189 (also known in the art as "propant") is pumped into the string 10 from a source at the surface (not shown). The gravel fluid 188 flows to the annulus 204 around the flow restriction device 100. The flow restriction device 100 prevents the gravel 189 from entering into the tool inside 116. The gravel 189 deposits or settles in the annulus 204 while the filtered fluid enters the opening 116 and travels uphole as shown by arrows 52. The supply of the gravel fluid is continued until the annulus 204 around the flow restriction device 100 is packed with the gravel 189.

Referring to FIGS. 3A–3D, after the desired amount of gravel 189 has been packed around the flow restriction device 100, the work string is picked-up, which opens bypass 220 in the service packer 180. Clean fluid 222 is pumped downhole, along the annulus fluid flow path shown by arrows 55 and returns uphole though the flow opening 224 via the port 172. This reverse circulation removes any excess sand or gravel from the work string.

Figure 4A:
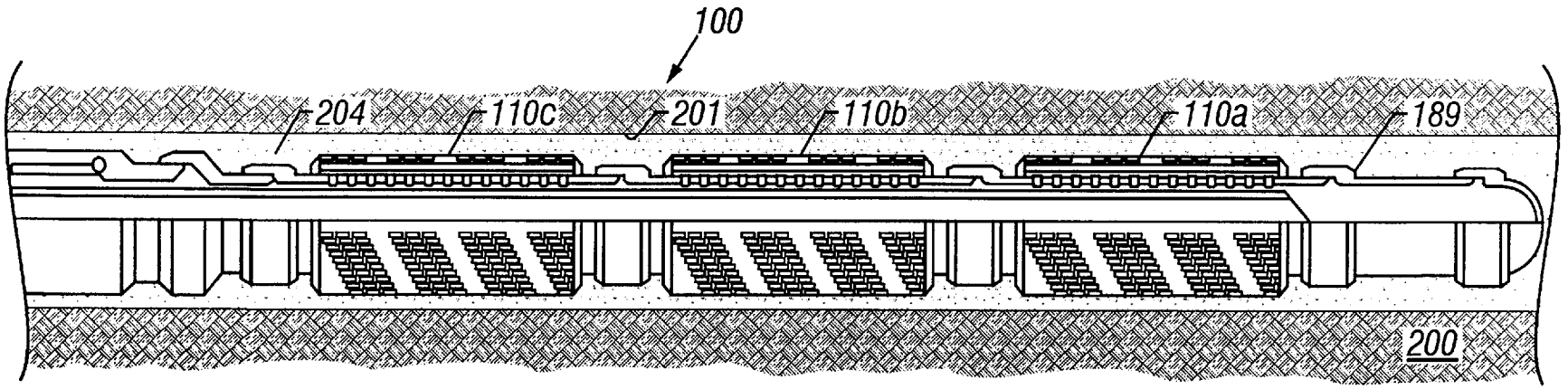
FIGS. 4A–4D show the gravel pack system of FIGS. 1A–1D after the Run-in tool and the service packers have been removed, leaving the screen and the liner packer in the wellbore.
Figure 4B:
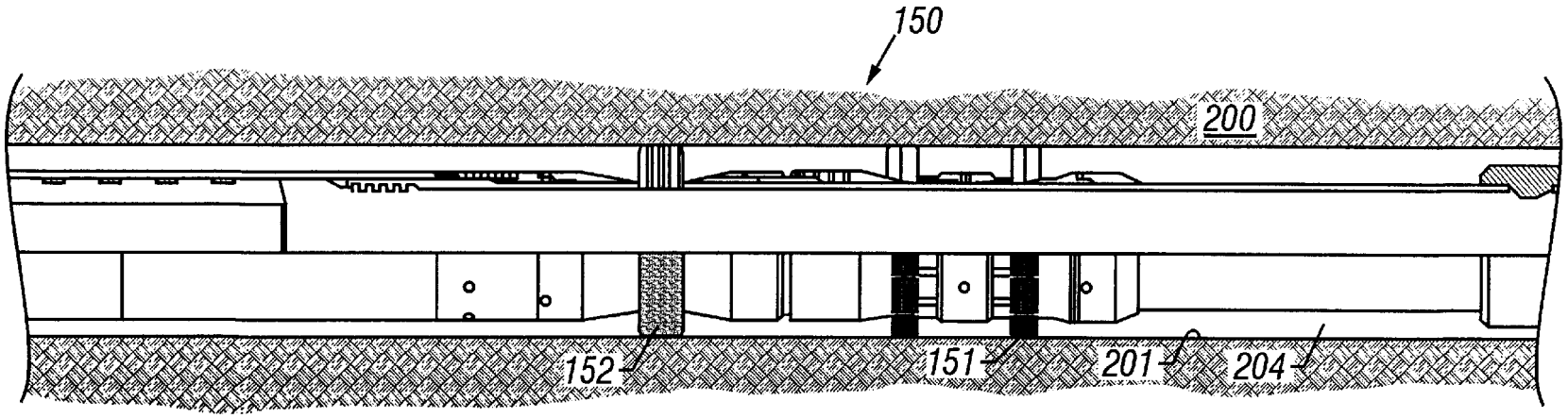
Figure 3C:
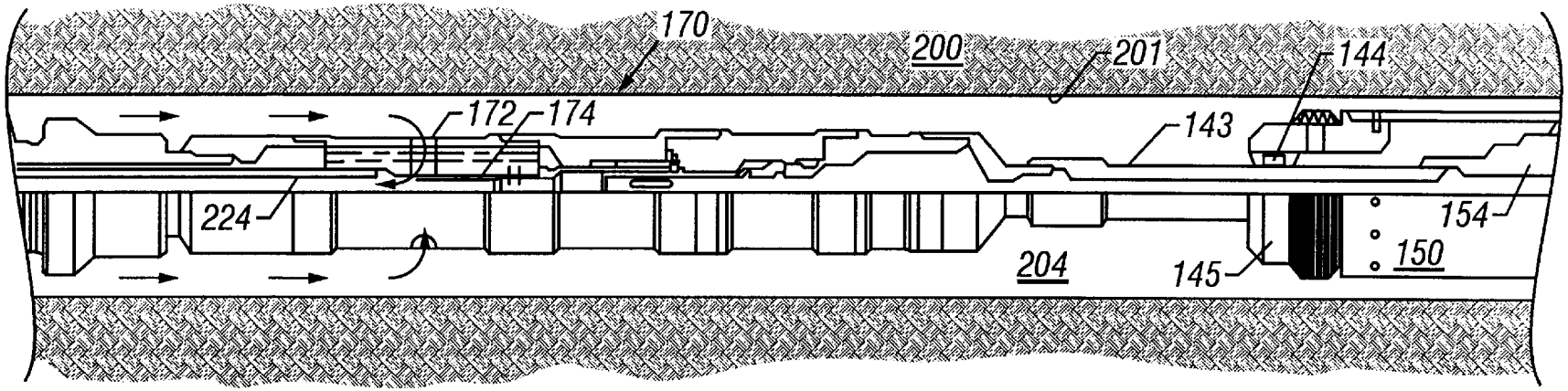
Figure 4C:
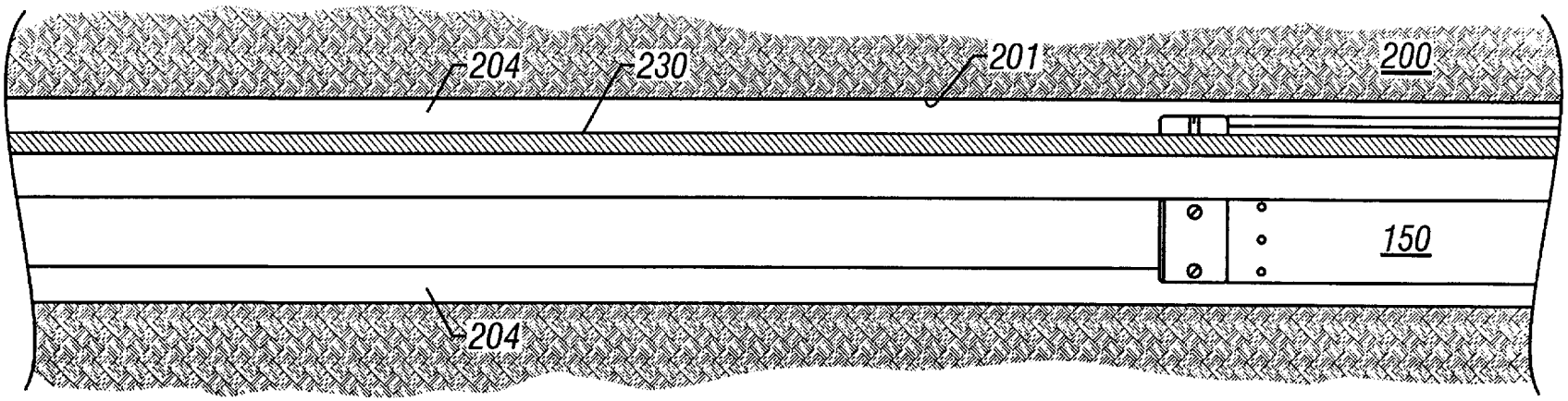
Figure 3D:
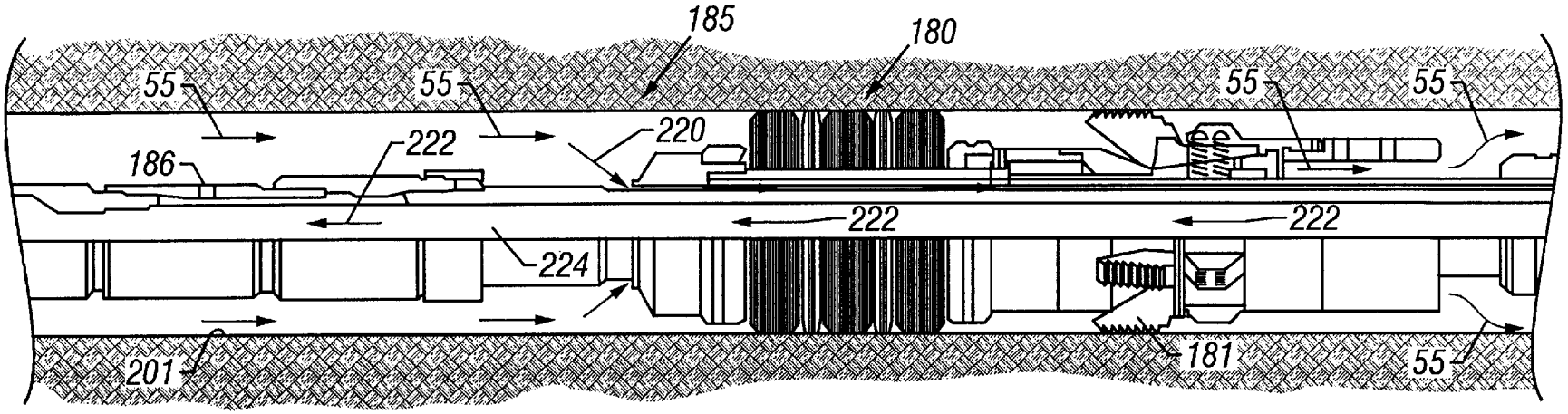
Figure 4D:
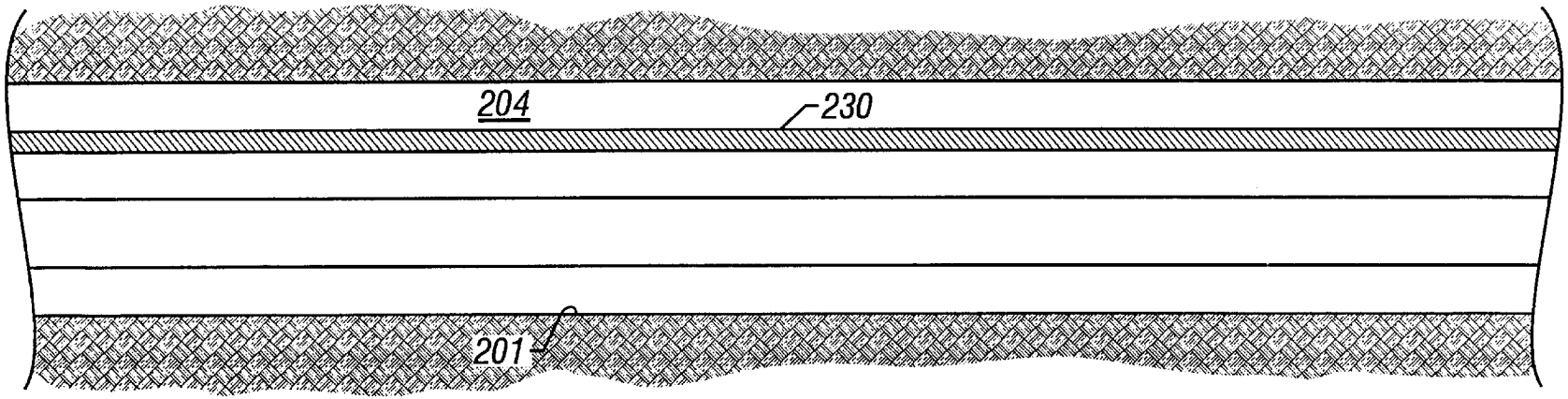

The junk bonnet 144 is then sheared off. The packer setting dog sub 154 is then removed. The liner packer 150 is then set and the string above the bottom hole assembly is pulled out of the wellbore 201. The work string, the gravel pack kit 185, the service packer 180 and the crossover device 170 are replaced by production tubing 230 (FIGS. 4B–4D).

It should be noted that in the particular method of this invention described herein, the liner packer 150 is set after the gravel pack operation has been completed, which allows maintaining the hydrostatic pressure on the formation throughout the gravel pack operations, thus, maintaining overbalanced or over burdened condition during all stages of the gravel packing operations. This system 10 also requires no gravel pack ports in the hook-up. Full inner dimensions or diameter is available throughout the operations. This method causes no swabbing or disturbance of the open hole filter cake.

The gravel pack system described herein above may utilize an combination of devices or any configuration that allows maintaining the hydrostatic pressure on the formation throughout the completion operations, such as gravel pack operations described above. The devices, such as packers, run-in tools, flow restriction devices described herein above are known in the oil field and thus are not described in great detail.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed:

1. A method of gravel packing a wellbore while maintaining said wellbore in an overburdened condition with a completion string having a flow restriction device that restricts flow of gravel and provides a fluid path between said wellbore and inside of said completion string, said method comprising:

conveying said completion string in said wellbore to position said fluid flow restriction device adjacent a selected formation while maintaining the wellbore in the overburdened condition, the space between the wellbore and the completion string defining an annulus;

setting the completion string to establish a first crossover fluid flow path in said completion string uphole of the fluid flow restriction device while maintaining said wellbore in the overburdened condition, said first crossover fluid flow path allowing fluid supplied to the completion string to pass from said completion string to said annulus;

setting the completion string to establish a return fluid path in said completion string while maintaining said wellbore in the overburdened condition, said return fluid path allowing fluid flowing from said selected formation, through said flow restriction device, into said completion string and from said completion string into said annulus uphole of said first crossover fluid flow path; and supplying a fluid mixture containing gravel under pressure to said completion string, thereby causing said mixture to flow into and gravel pack said annulus downhole of said first crossover fluid path.

2. The method of claim 1 wherein setting the completion string to establish the return fluid path includes establishing a second crossover fluid flow path uphole of said first crossover fluid flow path.

3. The method of claim 1 further comprising continuing to supply said mixture until an annulus between said formation and said flow restriction device is packed with a desired amount of the gravel.

4. The method of claim 1 further comprising setting a first packer in said completion string uphole of said first crossover fluid flow path while maintaining said wellbore under the overburdened condition.

5. The method of claim 4 wherein said first packer restricts fluid flow from said annulus below said first packer to the surface.

6. The method of claim 5 further comprising setting a second packer between said flow restriction device and said first crossover fluid flow path.

7. The method of claim 5 further comprising retrieving a portion of said completion string to the surface leaving said flow restriction device in said wellbore.

8. The method of claim 1 wherein setting the completion string to establish a first crossover fluid flow path includes hydraulically opening a valve in said completion string that allows fluid to communicate between said completion string and said annulus.

9. A method of gravel packing a wellbore with a completion string while maintaining the wellbore under overburdened condition, said completion string having a flow restriction device, a crossover device uphole of the flow restriction device and a first packer between the crossover device and the flow restriction device and a second packer uphole of the crossover device, wherein the crossover device in a first mode provides a fluid passage to the flow restriction device through the string and in a second mode blocks the fluid flow through the string and allows said fluid to flow into an annulus between the string and the wellbore below said second packer, said method comprising:

(a) conveying the completion string in the wellbore to position the flow restriction device adjacent a selected formation location, with the crossover device in said first mode;

(b) setting the crossover device to the second mode;

(c) setting the second packer, said second packer preventing uphole fluid flow from said crossover device along the annulus below said second packer and channeling uphole fluid flow from said string into said annulus above said second packer; and (d) supplying fluid with gravel to the completion string to gravel pack the annulus around the flow restriction device.

10. The method of claim 9 further comprising setting the first packer after completing the annulus gravel pack around the flow restriction device.

11. The method of claim 10 further comprising retrieving a portion of the completion string while leaving the flow restriction device and the first packer in the wellbore.

12. A well completion string comprising the assembled combination of:

(a) a fluid permeable screen;

(b) a first well annulus packer above said screen;

(c) a first fluid flow crossover port above the first packer;

(d) a second well annulus packer above said first crossover port;

(e) a second fluid flow crossover port above the second packer;

(f) a first internal flow path that is continuous from above said second crossover port to said screen;

(g) a second internal flow path that is continuous from said screen to said second crossover port;

(h) said first crossover port linking said first flow path with outer surroundings of said string below said second packer; and, (i) said second crossover port linking said second flow path with said outer surroundings above said second packer.

13. A well completion string as described by claim 12 having a selectively engaged flow obstruction in said first flow path below said first crossover port.

14. A well completion string as described by claim 13 wherein obstruction of the first flow path opens said first crossover port between said first flow path above said obstruction and said surroundings and opens said second crossover port between said second flow path and said surroundings.

15. A well completion string as described by claim 14 wherein obstruction of said first flow path also opens said first flow path into said second flow path at a point below said obstruction.

16. A well completion string as described by claim 13 wherein said second well annulus packer further comprises a selectively opened bypass flow path between said outer surroundings above said second packer and outer surroundings below said second packer.

* * * * *

UNITED STATES PATENT AND TRADEMARK OFFICE

CERTIFICATE OF CORRECTION

PATENT NO. : 6,230,801 B1
DATED : May 15, 2001
INVENTOR(S) : Leo E. Hill, Jr. and Christian F. Bayne It is certified that error appears in the above-identified patent and that said Letters Patent is hereby corrected as shown below:

Title page, Item [54], and column 1, line 1,
Please replace "APPARATUS AND METHOD FOR OPEN HOLD GRAVEL PACKING" with -- APPARATUS AND METHOD FOR OPEN HOLE GRAVEL PACKING --.

Signed and Sealed this

Fifth Day of February, 2002

*Attest:*

*Attesting Officer*

JAMES E. ROGAN
*Director of the United States Patent and Trademark Office*